United States Patent [19]

Hand

[11] Patent Number: 4,573,867

[45] Date of Patent: Mar. 4, 1986

[54] HOUSING FOR TURBOMACHINE ROTORS

[75] Inventor: Derek G. Hand, Bristol, England

[73] Assignee: Rolls-Royce Limited, London, England

[21] Appl. No.: 443,609

[22] Filed: Nov. 22, 1982

[30] Foreign Application Priority Data

Nov. 26, 1981 [GB] United Kingdom ..... 8135783

[51] Int. Cl.[4] ..... F01D 25/26

[52] U.S. Cl. ..... 415/134; 415/138; 415/136; 415/173 A

[58] Field of Search ..... 415/134, 136, 138, 139, 415/116, 117, 173 R, 170 A

[56] References Cited

U.S. PATENT DOCUMENTS

| | | | |
|---|---|---|---|
| 2,488,867 | 11/1949 | Judson | 415/136 |
| 2,700,530 | 1/1955 | Williams | 415/116 |
| 2,741,455 | 4/1956 | Hunter | 415/116 |
| 3,542,483 | 11/1970 | Gagliardi | 415/136 |
| 4,243,233 | 1/1981 | Arai | 415/170 A |

FOREIGN PATENT DOCUMENTS

| | | |
|---|---|---|
| 622895 | 5/1949 | United Kingdom . |
| 741549 | 12/1955 | United Kingdom . |
| 786689 | 11/1957 | United Kingdom . |
| 831412 | 3/1960 | United Kingdom . |
| 2019954 | 3/1979 | United Kingdom . |

*Primary Examiner*—Henry C. Yuen
*Assistant Examiner*—John Kwon
*Attorney, Agent, or Firm*—Parkhurst & Oliff

[57] ABSTRACT

A housing for a rotor of a turbomachine comprising, radially spaced inner and outer casings. The inner casing comprises a plurality of segments 20(*a*) to 20(*e*) each of which comprises one or more stator vanes 23. A first of the casings 19 has two or more axially spaced locating members 21,22 which co-operate with locating means 25,29 on the second of the casings 18 to locate the first casing 19 relative to the second casing 18. A first of the locating means 25 comprising a first surface 27 inclined to a direction extending axially along the second casing 18 and a second surface 28 that constitutes a sealing face. A first of the locating members 21 having a third surface 32 that confronts the first surface 27. In use, axial gas loads on the stator vanes 23 cause the first and third surfaces 27,32 to engage each other and slide along the incline to bring a fourth surface 33 on the member 21 into sealing engagement with the said second surface 28. A second of the locating members 22 has a fifth surface 36 which sealingly engages, and is movable axially relative to, a sixth sealing surface 30 of a second of the locating means 39.

18 Claims, 3 Drawing Figures

HOUSING FOR TURBOMACHINE ROTORS

BACKGROUND OF THE INVENTION

This invention relates to housings for turbomachines such as, for example, gas turbine engines, and, in particular, although not exclusively to housings for compressors of such machines.

During transient conditions of operation such as on start-up or run-down of such machines the temperature of the working fluid in the machine varies relatively quickly. Those parts of the machine in direct contact with the working fluid are thereby heated or cooled relatively quickly. However, the thermal response of components not in direct contact with the working fluid, is much slower and this can cause problems. For example, in gas turbine engine compressors or turbines having a bladed rotor comprising blades mounted on discs and disposed within a housing, the housing tends to heat up very quickly whereas the more massive rotor discs, which are shielded from the hot gases by the blade platforms and interstage spacers, heat up less quickly. The consequence is that the gap between the tips of the blades and the housing varies because of the differential thermal expansion. This can lead to fouling of the blades on the casing, or, if the gap becomes too large, to loss of efficiency or a surge in the engine.

It is known to construct turbine or compressor housings in the form of two radially spaced casings, and to match the expansion of the inner casing to that of the rotor by providing thermal insulating materials on the inner surface of the inner casing and heat sinks on the inner casing to slow down the thermal response of the casing. Such a compressor casing is described in our British Pat. No. 1,501,916. The casing described in this patent comprises an inner casing made up of annular stator rings carrying stator vanes, and the outer casing comprises cylindrical rings or two half casings joined along longitudinal axes and assembled around the outside of the inner casing and bolted to it.

One of the problems with compressor housings employing inner casing segments which locate in an outer casing is that pressurised air leaks into the space between the inner and outer casing from high pressure regions of the compressor and tends to flow back towards the lower pressure stages of the compressor. This reduces the efficiency of the compressor and has a detrimental effect on the overall thermodynamic cycle of the turbomachine.

SUMMARY OF THE INVENTION

An object of the present invention is to improve the sealing between co-axially adjacent inner segments to minimize the leakage of air into the gap between the inner and outer casings.

It is an object of the present invention to provide a housing for a turbine or compressor of a turbomachine in which the thermal response of the housing is designed to match substantially the thermal response of the turbine or compressor rotor assembly, as the case may be, so as to control the operating clearance between the casing and its respective rotor assembly.

The invention as claimed utilizes the axial forces, and the turning moment produced on the inner casing segments by the gas loads on the segments, to urge the segments into contact with the inclined surface so that the segments slide into contact with other surfaces to establish an effective air seal.

The present invention will now be described, by way of an example, with reference to the accompanying drawing in which:

DETAILED DESCRIPTION OF PREFERRED EMBODIMENTS

Figure 1:
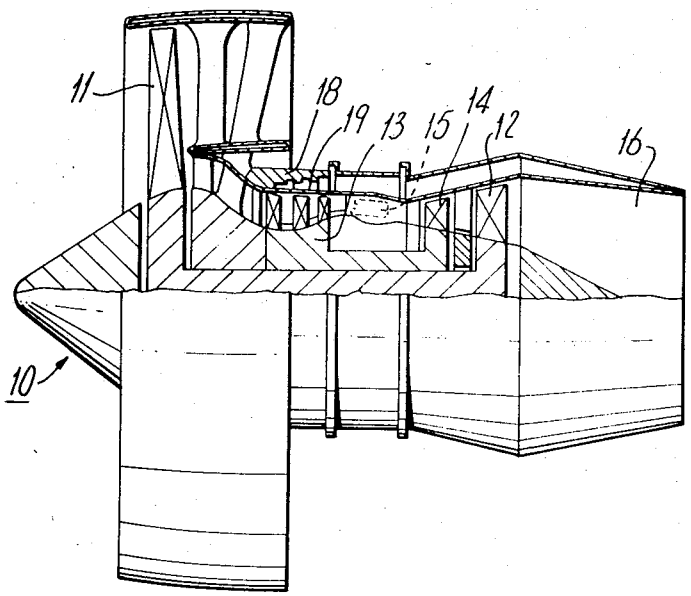
FIG. 1 illustrates schematically a gas turbine aero-engine incorporating the present invention.

Referring to the drawings, FIG. 1 shows a ducted fan aero-engine 10 comprising a front mounted low pressure compressor 11 driven by a turbine 12, a high pressure compressor 13 driven by a turbine 14, a combustion chamber 15 for generating hot gases to drive the turbine 12 and 14 and an exhaust jet pipe 16.

Figure 2:
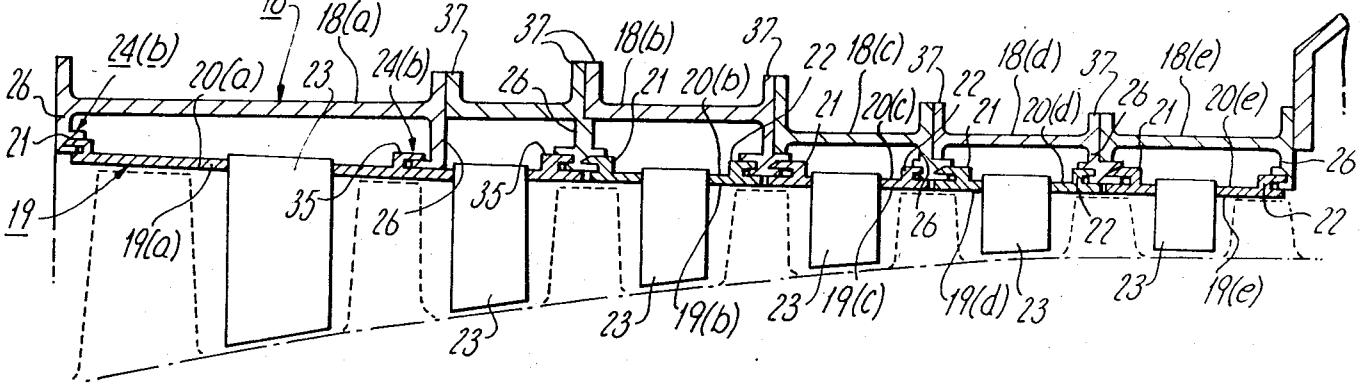
FIG. 2 shows in greater detail part of the housing of the high pressure compressor of the engine of FIG. 1 constructed in accordance with the present invention.
Figure 3:
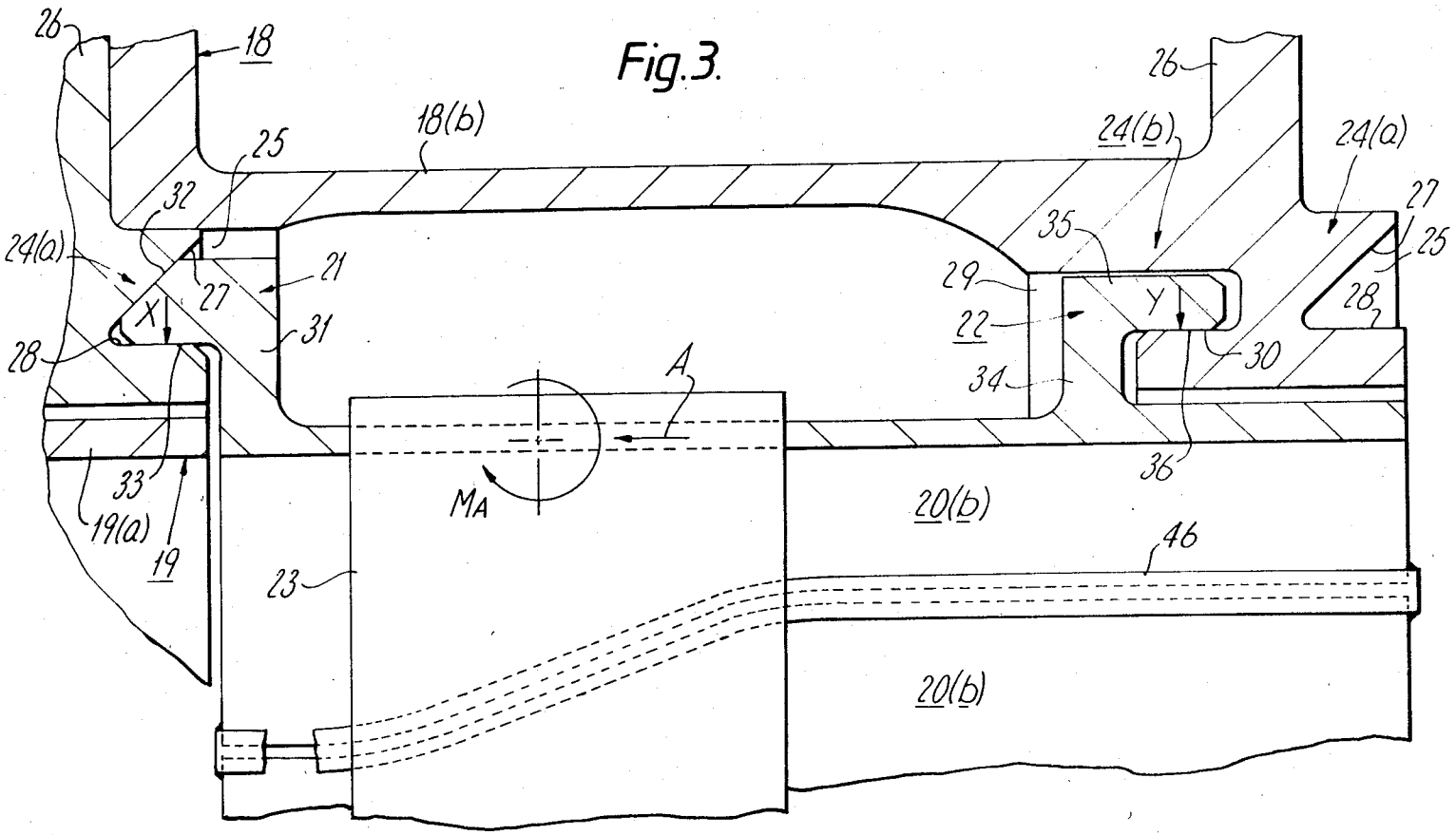
FIG. 3 illustrates in greater detail part of the housing of FIG. 2.

Referring to FIGS. 2 and 3 at least the rearmost part of the H.P. compressor 13 is accommodated within an outer hollow cylindrical casing 18 made up of a plurality of cylindrical sections 18(*a*) to 18(*e*) assembled end-to-end along the axis of the compressor. The section 18(*a*) to 18(*e*) may each be fabricated from one part or a plurality of parts bolted together along a joint or flange which extends in a direction along the length of the compressor. Located within the outer casing, and spaced from it, is an inner casing 19.

The inner casing 19 comprises a plurality of hollow cylindrical sections 19(*a*) to 19(*e*) assembled end-to-end along the length of the compressor. Each section 19(*a*) to 19(*e*) comprises a plurality of segments 20(*a*) to 20(*e*) which are spaced apart circumferentially to define a gap which allows circumferential expansion and contractions of the segments relative to one another. These gaps between the segments 20(*a*) to 20(*e*) extend in a longitudinal direction and are sealed by means of a longitudinal sealing strip 46 that overlaps the segments 20(*a*) to 20(*e*) to provide an effective air seal.

Each of the segments 20(*a*) to 20(*e*) is provided with at least two axially spaced sets of fixing devices comprising locating members 21,22 (shown in greater detail in FIG. 3) which locate in locating means 24(*a*), 24(*b*) provided on the outer casing 18. The segments 20(*a*) have one locating member 21 and two locating members 22. Each segment 20(*a*) to 20(*e*) comprises a plurality of stator vanes 23 cantilevered from the circumferential wall of each segment.

Referring in particular to FIG. 3 it will be seen that the locating means 24(*a*), on the outer casing 18 comprises a recess 25 at the radially innermost end of a radial flange 26 of each section 18(*a*) to 18(*e*). The recess 25 is defined by two surfaces namely a surface 27 inclined to a direction extending axially along the outer casing, and an axially extending circumferential surface 28 that defines a sealing surface. The flanges 26 also have a second locating means 24(*b*) defined by a recess 29 in which an adjacent segment locates. The second recess 29 has an axially extending cylindrical surface 30 which lies on the same radius as the surface 28 and the surfaces 28 and 30 support the segments 20 at a fixed radius when the compressor is stopped. Section 18(*a*) of the outer casing has an additional flange 26 partway along its length. This additional flange is provided with a recess 29 which is identical to the other recesses 29.

The locating members 21, of each segment 20(*a*) to 20(*e*) comprises an upstanding circumferential flange 31 that projects towards the outer casing 18 and has an inclined surface 32 that confronts the inclined surface 27 of the recesses 25, and a circumferential surface 33 that engages the surface 28.

The locating members 22 of the segments 20(*a*) to 20(*e*) comprise an upstanding circumferential flange 34 that projects towards the outer casing 18. The flange 34 has a hook portion 35 defined by a cylindrical flange, and the hook portion 35 has a circumferential surface 36 that engages the surface 30.

In operation, gas loads exerted on the segments 20(*a*) to 20(*e*) by the compressed air as it flows axially through the compressor 13 acts on the stator vanes 23 to push the segments 20(*a*) to 20(*e*) forwards an indicated by arrow A (FIG. 3). This causes the inclined surface 32 to engage the inclined surface 27 and slide down the incline urging the surfaces 33 and 28 together into sealing engagement. At the same time the cylindrical surfaces 36 and 30 permit the segments 20(*a*) to 20(*e*) to slide axially relative to the outer casing.

The gas loads impart a turning moment to the segments 20 which is clockwise as viewed in FIG. 3 (shown by arrow Ma). The net effect of the forwards movement of the segment and the rotation of the segments due to the turning moment is to urge the surfaces 33 and 36 radially inwards to effect an air seal at regions X and Y to minimize leakage of air into the gap between the casing 18,19.

The segments 20(*a*) each have a plurality of rows of stator vanes 23 nevertheless the inclined surfaces effect a seal at the front of each segment 20(*a*) and the hooks 35 effect air seals on the surfaces 30.

The present invention may be applied to housings for turbine rotors. In this case the gas loads act rearwards to the inclined surfaces 27 and 32 would be provided at the rear of the segments.

It is to be understood that the locating members 21,22 may be provided on the outer casing 18 and the locating means (i.e. recesses 25,29 provided on the inner casing 19). That is to say that the arrangement shown in FIG. 3 could be reversed.

It is also to be understood that although the inclined surfaces 27 are shown as facing radially inwards they may be arranged to face outwards in which case the circumferential surfaces 28 and 30 would face inwards and confront the inclined surfaces so that as the inclined surfaces slide along the incline the surfaces 28,33 are urged together.

In a further modification the surfaces 28 and 30 need not be cylindrical but could be conical to form a diverging recess. In this case the surfaces 33,36 could by cylindrical (in which case they would engage surfaces along a line contact) or conical. However, this arrangement is not preferred because of the difficulty of locating the segments on a predictable radius.

The outermost flanges 37 of the outer casing 18 constitute thermal slugging masses that control the rate of heat dissipation from the inner casing 19 through the flanges 26 and 37. If desired, the outercasing 18 may be surrounded with a further casing or sleeve to define a chamber around the outercasing 18, through which air can flow to enable one to control more precisely the flow of heating or cooling air over the slugging masses. In this way it may be possible to control the tip clearances of the rotor blades. In this latter described arrangement the inner and outer casings 18,19 form the structural housing for the compressor rotor.

Furthermore, since the inner casing 19 is located in recesses in the outer casing, radial movements of the inner casing can be controlled easier and hence one can achieve better control of the clearances of the tips of the stator vanes 23 and rotor blades.

I claim:

1. A housing for a rotor of a turbomachine comprising: radially spaced inner and outer casings, the inner casing comprising a segmented hollow cylinder each segment of which has one or more stator vanes projecting radially inwards, the inner casing being located relative to the outer casing by two or more axially spaced sets of fixing devices; each fixing device comprising a pair of locating means one of which is provided on the outer casing and the other of which is provided on each segment of the inner casing, one of the locating means of each fixing device of a first of the sets being provided with a first surface inclined to a direction extending axially along the casings and a second surface that constitutes a sealing face which lies at an angle to the first surface, and the other locating means of each fixing device of the first set being provided with third and fourth surfaces that confront and engage respectively the said first and second surfaces; one of the locating means of each fixing device of a second of the sets being provided with a fifth surface and the other locating means of each pair of the second set having a sixth surface that confronts, engages, and is movable axially relative to the fifth surface, the first, second, third, fourth, fifth and sixth surfaces all being positioned, shaped, and arranged, relative to each other so that, in use, gas loads acting on the vanes urge the segments in an axial direction and thereby urge the third surface into contact with the first surface and cause the segments to slide in a direction along the incline of the first surface to urge the fourth and sixth surface into sealing contact with respectively the second and fifth surfaces, thereby providing a sealing means at each locating means.

2. A housing according to claim 1 wherein the locating means of the first set of fixing devices is provided at an upstream end of each segment and the second set of fixing devices is provided at a downstream end of each segment.

3. A housing according to claim 1 wherein the locating means having the first and second surfaces and the locating means having said fifth surface are provided on the outer casing and the locating means having said third and fourth surfaces and the locating means having said sixth surface are provided on each of the segments.

4. A housing according to claim 1 wherein the locating means having the first and second surfaces and the locating means having said fifth surface are provided on each segment and the locating means having said third and fourth surfaces and the locating means having said sixth surface are provided on the outer casing.

5. A housing according to claim 1 wherein an additional sealing means is provided to seal circumferential gaps between adjacent segments that define the inner casing.

6. A housing according to claim 1 wherein the locating means having the first and second surfaces is provided with a recess which has two mutually confronting surfaces that define said first and second surfaces.

7. A housing according to claim 1 wherein the second surface lies at an acute angle to the first surface.

8. A housing according to claim 1 wherein the second and fifth surfaces are cylindrical surfaces.

9. A housing according to claim 8 wherein the second and fifth surfaces are a cylindrical surface with a common radius.

10. A housing according to claim 1 wherein the second and fifth surfaces are conical surfaces.

11. A housing according to claim 8 wherein the fourth and sixth surfaces are cylindrical surfaces that co-operate with the second and fifth surfaces.

12. A housing according to claim 10 wherein the fourth and sixth surfaces are conical surfaces which are of complementary shape to that of the second and fifth surfaces.

13. In a housing for a rotor of a turbomachine having an outer casing and an inner casing coupled to and radially spaced from said outer casing, said inner casing enclosing a rotor which rotates about an axis extending through said casing and includes at least one stator vane projecting radially within said inner casing, said inner casing defining a passage for gas flow during operation of said turbomachine, the improvement in said inner and outer casing comprising:

said inner casing being formed as a segmented cylinder with each segment having first and second end portions;

means for coupling said first end portion of each segment to said outer casing such that gas loads acting on said vanes during operation of said turbomachine cause movement of said segments along said axis and cause sealing engagement of said first end portion with said outer casing; and means coupling said second end portion of each segment to said outer casing such that gas loads acting on said vanes cause rotation of said segments and move said second end portion of each segment into sealing engagement with said outer casing;

wherein said means for coupling said first end portion of each segment to said outer casing includes said first end portion of each segment being formed to define a conical surface adjacent to a cylindrical surface and said outer casing adjacent said first end portion being constructed to form a recess having a tapered surface adjacent to a cylindrical surface, said first end portion being received within said recess such that said conical surface engages said tapered surface during movement of a segment along said axis to cause sealing engagement of said first end portion with said outer casing by engagement of said cylindrical surfaces; and wherein said means for coupling said second end portion of each segment to said outer casing includes said second end portion being formed as a cylindrical flange having a cylindrical surface and said outer casing adjacent said second end portion being formed as a cylindrical recess having a cylindrical surface, said cylindrical flange being received within said cylindrical recess such that the cylindrical surfaces of said cylindrical flange and cylindrical recess engage one another upon rotation of said segments to cause sealing engagement of the second end portion of each segment with said outer casing.

14. A turbomachine comprising:

a cylindrical outer casing;

a segmented cylindrical inner casing positioned within and spaced from said outer casing and defining a gas flow passage having an axis extending therethrough, each of said segments having a first end portion, a second end portion and at least one stator vane projecting radially within said cylindrical segment;

means for coupling the first end portion of each segment to said outer casing such that gas loads in said passage acting on said stator vanes during operation of a turbomachine cause movement of a segment along said axis and sealing engagement of said first end portion with said outer casing to prevent gas leakage from said passage to between said inner and outer casings; and means for coupling the second end portion of each segment to said outer casing such that gas loads acting on stator vanes during operation of a turbomachine cause rotation of a segment to move said second end portion into sealing engagement with said outer casing to prevent gas leakage from said passage to between said inner and outer casings;

wherein said means for coupling said first end portion of each segment to said outer casing includes said first end portion of each segment being formed to define a conical surface adjacent to a cylindrical surface and said outer casing adjacent said first end portion being constructed to form a recess having a tapered surface adjacent to a cylindrical surface, said first end portion being received within said recess such that said conical surface engages said tapered surface during movement of a segment along said axis to cause sealing engagement of said first end portion with said outer casing by engagement of said cylindrical surfaces; and wherein said means for coupling said second end portion of each segment to said outer casing includes said second end portion being formed as a cylindrical flange having a cylindrical surface and said outer casing adjacent said second end portion being formed as a cylindrical recess having a cylindrical surface, said cylindrical flange being received within said cylindrical recess such that the cylindrical surfaces of said cylindrical flange and cylindrical recess engage another upon rotation of said segments to cause sealing engagement of the second end portion of each segment with said outer casing.

15. The apparatus of claims 13 or 14 wherein said means for coupling said first end portion of each segment to said outer casing includes one of said first end portion and said outer casing adjacent said first end portion being formed as a projection defined by a conical surface adjacent to a cylindrical surface and the other of said selected one of said first end portion and said outer casing adjacent said first end portion being formed as a recess defined by a tapered surface adjacent to a cylindrical surface, said projection being configured and received in said recess such that said conical surface engages said tapered surface during movement of a segment along said axis to cause sealing engagement of the cylindrical surfaces of said projection and said recess.

16. The apparatus of claim 15 wherein said means for coupling said second end portion of each segment to said outer casing includes one of said second end portion and said outer casing adjacent said second end portion being formed as a cylindrical flange having a cylindrical surface and the other of said second end portion and said outer casing adjacent said second end portion being formed as a cylindrical recess having a cylindrical surface, said cylindrical flange being received in said cylindrical recess such that the cylindrical surfaces of said flanges and recess engage one another upon rotation of a segment to cause said sealing engagement of said second end portion of each segment with said outer casing.

17. In a housing for a rotor of a turbomachine having an outer casing and an inner casing coupled to and radially spaced from said outer casing, said inner casing enclosing a rotor which rotates about an axis extending through said casing and includes at least one stator vane projecting radially within said inner casing, said inner casing defining a passage for gas flow during operation of said turbomachine, the improvement in said inner and outer casing comprising:

said inner casing being formed as a segmented cylinder with each segment having first and second end portions;

means for coupling said first end portion of each segment to said outer casing such that gas loads acting on said vanes during operation of said turbomachine cause movement of said segments along said axis and cause sealing engagement of said first end portion with said outer casing; and means coupling said second end portion of each segment to said outer casing such that gas loads acting on said vanes cause rotation of said segments and move said second end portion of each segment into sealing engagement with said outer casing;

wherein said means for coupling said first end portion of each segment to said outer casing includes a projection of said outer casing adjacent to said first end portion of each segment formed to define a conical surface adjacent to a cylindrical surface and each said first portion being constructed to form a recess having a tapered surface adjacent to a cylindrical surface, said projection being received within said recess such that said conical surface engages said tapered surface during movement of a segment along said axis to cause sealing engagement of said first end portion with said outer casing by engagement of said cylindrical surfaces; and wherein said means for coupling said second end portion of each segment to said outer casing includes said second end portion being formed as a cylindrical flange having a cylindrical surface and said outer casing adjacent said second end portion being formed as a cylindrical recess having a cylindrical surface, said cylindrical flange being received within said cylindrical recess such that the cylindrical surfaces of said cylindrical flange and cylindrical recess engage one another upon rotation of said segments to cause sealing engagement of the second end portion of each segment with said outer casing.

18. A turbomachine comprising:

a cylindrical outer casing;

a segmented cylindrical inner casing positioned within and spaced from said outer casing and defining a gas flow passage having an axis extending therethrough, each of said segments having a first end portion, a second end portion and at least one stator vane projecting radially within said cylindrical segment;

means for coupling the first end portion of each segment to said outer casing such that gas loads in said passage acting on said stator vanes during operation of a turbomachine cause movement of a segment along said axis and sealing engagement of said first end portion with said outer casing to prevent gas leakage from said passage to between said inner and outer casings; and means for coupling the second end portion of each segment to said outer casing such that gas loads acting on stator vanes during operation of a turbomachine cause rotation of a segment to move said second end portion into sealing engagement with said outer casing to prevent gas leakage from said passage to between said inner and outer casings;

wherein said means for coupling said first end portion of each segment to said outer casing includes a projection of said outer casing adjacent to said first end portion of each segment formed to define a conical surface adjacent to a cylindrical surface and each said first end portion being constructed to form a recess having a tapered surface adjacent to a cylindrical surface, said projection being received within said recess such that said conical surface engages said tapered surface during movement of a segment along said axis to cause sealing engagement of said first end portion with said outer casing by engagement of said cylindrical surfaces; and wherein said means for coupling said second end portion of each segment to said outer casing includes said second end portion being formed as a cylindrical flange having a cylindrical surface and said outer casing adjacent said second end portion being formed as a cylindrical recess having a cylindrical surface, said cylindrical flange being received within said cylindrical recess such that the cylindrical surfaces of said cylindrical flange and cylindrical recess engage one another upon rotation of said segments to cause sealing engagement of the second end portion of each segment with said outer casing.

* * * * *